United States Patent [19]

Oba

[11] Patent Number: 4,828,411

[45] Date of Patent: May 9, 1989

[54] TENSIONING APPARATUS FOR AN INK RIBBON CASSETTE

[75] Inventor: Yasuo Oba, Kawasaki, Japan

[73] Assignee: Canon Kabushiki Kaisha, Tokyo, Japan

[21] Appl. No.: 226,516

[22] Filed: Jul. 29, 1988

Related U.S. Application Data

[63] Continuation of Ser. No. 947,910, Dec. 31, 1986, abandoned.

[30] Foreign Application Priority Data

Jan. 8, 1986 [JP] Japan ..... 61-1598
Jan. 8, 1986 [JP] Japan ..... 61-1599
Jan. 8, 1986 [JP] Japan ..... 61-1600

[51] Int. Cl.[4] ..... B41J 32/02

[52] U.S. Cl. ..... 400/196.1; 400/208; 400/234

[58] Field of Search ..... 400/194–196.1, 400/208, 234

[56] References Cited

U.S. PATENT DOCUMENTS

| | | | |
|---|---|---|---|
| 2,755,905 | 7/1956 | Segui | 400/196 |
| 3,814,231 | 6/1974 | Cappotto | 400/196.1 X |
| 3,989,132 | 11/1976 | Carson | 400/196.1 X |
| 4,053,042 | 10/1977 | Hess | 400/196 |
| 4,074,799 | 2/1978 | Hishida | 400/234 X |
| 4,232,976 | 11/1980 | Bernardis | 400/196.1 |
| 4,373,824 | 2/1983 | Olsen | 400/234 |
| 4,388,006 | 6/1983 | Waibel | 400/196 X |
| 4,605,327 | 8/1986 | Ueki et al. | 400/208 |

FOREIGN PATENT DOCUMENTS

| | | | |
|---|---|---|---|
| 3346607 | 7/1985 | Fed. Rep. of Germany | 400/208 |
| 2509226 | 1/1983 | France | 400/196.1 |
| 212698 | 8/1984 | German Democratic Rep. | 400/208 |
| 105383 | 6/1982 | Japan | 400/196.1 |
| 2081220 | 2/1982 | United Kingdom | 400/208 |

OTHER PUBLICATIONS

*IBM Tech. Disc. Bulletin*, by A. A. Dowd, vol. 20, No. 11B, Apr. 1978, pp. 4739–4740.

*Primary Examiner*—Paul T. Sewell
*Attorney, Agent, or Firm*—Fitzpatrick, Cella, Harper & Scinto

[57] ABSTRACT

An ink ribbon cassette comprises an endless type ink ribbon and a cassette casing for enclosing the ink ribbon. The cassette casing includes an enclosing portion for enclosing the ink ribbon in an irregularly piled state, a guide portion for pulling out and exposing the ink ribbon to the outside and for guiding the exposed ink ribbon to be again enclosed into the enclosing portion, take-up means for taking up the ink ribbon, and braking means, for applying a brake force to the feeding operation of the ink ribbon.

5 Claims, 4 Drawing Sheets

TENSIONING APPARATUS FOR AN INK RIBBON CASSETTE

This application is a continuation of application Ser. No. 947,910 filed Dec. 31, 1986, now abandoned.

BACKGROUND OF THE INVENTION

1. Field of the Invention

The present invention relates to an ink ribbon cassette using an endless type ink ribbon.

2. Related Background Art

FIG. 1 shows an ink ribbon cassette using an endless type ribbon. In FIG. 1, an endless type fabric ribbon 2 is enclosed in an enclosing portion 1*a* in a casing 1. The ribbon pulled out of the enclosing portion 1*a* is pressed to an inner wall 1*b* by a tension spring 3 in the portion A. Thereafter, the ribbon is pulled out to the outside.

The ink ribbon pinched by a pressing roller 4 and a gear portion (not shown) of a cassette knob 5 is pulled in the direction of a by the rotation in the direction indicated by an arrow of the cassette knob and again enclosed into the enclosing portion 1*a*.

However, according to the conventional ink ribbon cassette, when the ink ribbon is slightly pulled out and released, a slack occurs. In addition, according to the conventional cassette, since the surface of the ink ribbon is always rubbed by the tension spring, the ribbon is easily damaged. On the other hand, in the case of the fabric ribbon, when the ribbon is pressed by the tension spring, the ink in the ribbon comes oozing out of the ribbon and the collected ink is carried by the ribbon out to the outside, so that a variation in concentration upon printing is likely to occur.

FIG. 2 shows a general ink ribbon cassette using a fabric ribbon.

A casing 11 consists of upper and lower casings. A ribbon 13 is irregularly piled and enclosed in an enclosing portion 12. The enclosed ribbon 13 passes through a plurality of substantially <-shaped ribs 14 which are formed integrally with the upper and lower casings. The ribbon 13 then passes between a pair of rollers 15 and 16. Thereafter, the ribbon 13 is guided by a pair of arms 17 and 18 so as to be exposed to the outside. The exposed ribbon 13 is moved into engagement with and pinched by a feed gear (not shown) and a pressing gear 20 which are formed integrally with a feed knob 19. When the feed knob 19 rotates in the direction of an arrow, the ribbon is wound in the direction of a and again enclosed into the enclosing portion 12.

The ribs 14 have the function to prevent the ribbon in the enclosing portion 12 from rushing between the pair of rollers 15 and 16 when the ribbon is taken up by the feed knob 19 and enclosed into the enclosing portion 12.

According to the ribbon cassette having such a structure, hitherto, the ribs 14 are formed as shown in FIG. 3. Namely, the ribs 14 are respectively vertically projected from an upper casing 11*a* and a lower casing 11*b* and vertical riser portions 14*a* obstruct the smooth feeding motion of the ink riboon.

SUMMARY OF THE INVENTION

It is an object of the present invention to provide an ink ribbon cassette in which the feeding motion of the ink ribbon can be optimized.

Another object of the invention is to prevent a slack which will be caused even when the endless ribbon is pulled out.

The above and other objects and features of the present invention will become apparatus from the following detailed description and the appended claims with reference to the accompanying drawings.

DETAILED DESCRIPTION OF THE PREFERRED EMBODIMENTS

Figure 4:
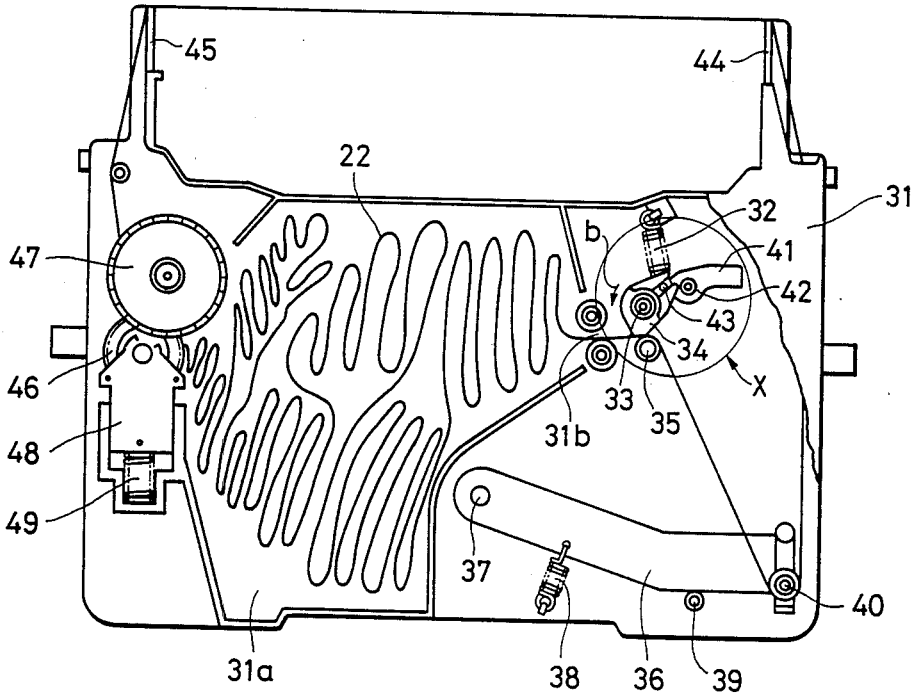
FIGS. 4 and 5 are explanatory diagrams of the first embodiment of the present invention.

FIG. 4 shows the first embodiment of the present invention. A ribbon casing 31 consists of upper and lower casings. An ink ribbon 22 irregularly piled in an enclosing portion 31*a* is enclosed in the casing 31. The ink ribbon in the enclosing portion 31*a* is pulled out of an opening 31*b* and pressed to a boss 35 by a lock claw 34 which is rotated and urged in the direction of b by a spring 32 around an axis 33 as a rotational center. Thus, the lock claw 34 brakes the feeding motion of the ribbon. A tension lever 36 is rotatable around an axis 37 as a rotational center and is ordinarily pressed by a spring 38 so as to be come into contact with a stopper 39. A roller 40 adapted to guide and support the ribbon is attached to the tip of the tension lever 36. A release lever 41 is provided to unlock the lock claw 34. The release lever 41 is rotatable around an axis 42 as a rotational center and rotates interlockingly with the lock claw 34 by a pin 43.

The ink ribbon is guided by a pair of arms 44 and 45 so as to be exposed to the outside. Further, the ink ribbon is moved into engagement with and pinched between a pressing gear 46 and the gear portion (not shown) of a cassette knob 47 and is again led into the enclosing portion 31*a*. A holder 48 holds the pressing gear 46 and is pressed by a spring 49 in the direction of the cassette knob 47.

The operation of the first embodiment will now be described.

Figure 5:
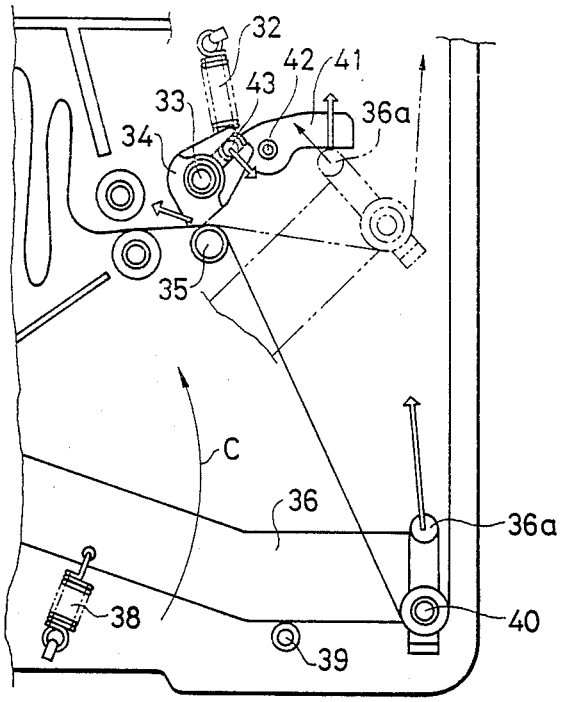

In FIG. 5, if the force to pull out the ribbon to the outside acts on the ribbon for any reason, since the lock claw 34 always locks the ribbon, the tension lever 36 will tend to rotate from the position indicated by solid lines shown in FIG. 5 to the position indicated by alternate long and two short dashes lines in the direction of c. However, the force always acts on the tension lever 36 by the spring 38 so as to rotate the tension lever 36 in the direction opposite to the direction of c. The force to pull out the ink ribbon to the outside is extinguished and at the same time, the tension lever 36 is returned to the position indicated by the solid lines. Therefore, the ink ribbon will never remain slack.

On the other hand, when the cassette knob 47 actually starts rotating and the take-up of the ribbon is started, the tension lever 36 gradually rotates in the direction of c. When the tension lever 36 reaches the position indicated by the alternate long and two short dashed lines, a tip 36*a* of the tension lever 36 is in contact with the release lever 41. Thus, as the tension lever further rotates in the direction of c, the contact release lever 41 starts rotating around the axis 42 as a rotational center. At the same time, lock claw 34 is pressed to the pin 43 projected from the release lever 41 itself and starts rotating, so that the ribbon is unlocked.

When the lock claw 34 is removed from the ribbon in this manner, the ink ribbon in the enclosing portion 31*a* is pulled out. The tension lever 36 again rotates in the direction opposite to the direction of c, thereby allowing the lock claw 34 to be come into contact with the ink ribbon and locking it. The ink ribbon is fed while repeating the contact→release→contact of the lock claw as mentioned above. Therefore, no excessive tension is applied to the ink ribbon. In addition, the lock lever 34 does not wring nor rub the ink ribbon. Therefore, the ribbon is hardly damaged and even if a carbon ribbon or the like is used as well as a fabric ribbon, the constitution of the embodiment is preferable. In addition, since the ribbon is not wrung, the ink is not collected and a variation in concentration upon printing hardly occurs.

Figure 6:
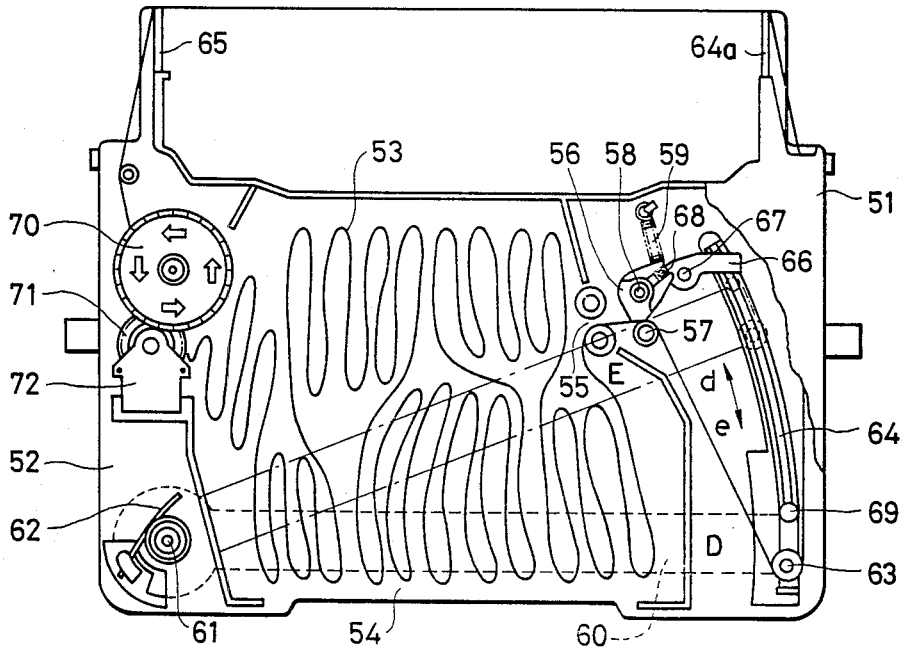
FIG. 6 is an explanatory diagram of the second embodiment of the invention.

FIG. 6 shows the second embodiment of the invention. An upper casing 51 together with a lower casing 52 forms a cassette casing. An endless fabric type ribbon 53 is irregularly piled and enclosed in a cassette enclosing portion 54. The ribbon 53 in the enclosing portion 54 is pulled out of an outlet 55 and elastically pressed to a boss 57 by a lock claw 56 and is applied with a frictional force. The lock claw 56 is rotatable around an axis 58 as a rotational center and always pressed by a spring 59 in the direction so as to abut on the boss 57. A tension lever 60 is rotatably attached to an axis 61 on the side of the lower surface of the lower casing 52 so as to be exposed to the outside from the cassette casing. The axis 61 is provided in the left lower side portion of the enclosing portion 54. A screw spring 62 attached around the axis always presses the tension lever 60 in the direction of e. The tension lever 60 is retained and stopped by a stopper (not shown). On the other hand, a roller 63 adapted to guide the ribbon passed through the boss 57 and serving as an operational point to apply a tension to the ribbon is arranged at the position of the tension lever 60 corresponding to the right lower side portion of the enclosing portion 54. The roller 63 enters the cassette frbm a guide groove 64 formed in the lower casing and guides the ribbon. The ribbon passed through the roller 63 is exposed to the outside by arms 64*a* and 65.

A release lever 66 is provided to unlock the lock claw 56. The release lever 66 is rotatable around an axis 67 as a rotational center and rotates integrally with the lock claw 56 by a pin 68. As will be explained hereinafter, the release lever 66 rotates and releases the lock claw 56 from the ink ribbon 53 when the release lever 66 is pressed to a pin 69 provided for the tension lever 60.

The ribbon 53 exposed to the outside by the arms 64*a* and 65 is moved into engagement with and pinched between a feed gear (not shown) and a pressing gear 71 integrally formed with a feed knob 70. The ribbon is again fed into the enclosing portion 54 by the rotation of the feed knob 70 in the direction indicated by an arrow. A holder 72 supports the pressing gear.

The operation of the second embodiment will now be explaned.

First, when the tension lever 60 is located at the position of D, by slightly pinching and pulling out the ink ribbon 53, the tension lever 60 rotates in the direction of d and absorbs this motion. Thus, when the ribbon is released, the ribbon is returned to the original stretched state without remaining slack due to the rotational return of the tension lever 60. Next, when the feed knob 70 is continuously rotated to take up the ribbon, the tension lever 60 first rotates from the position of D in the direction of d and reaches the position of E. The lension lever 60 further rotates from this position in the direction of d. Therefore, the pin 69 rotates the release lever 66 and also rotates the lock claw 56 against the force of the spring 59, thereby removing the lock claw 56 from the ink ribbon. Consequently, a small amount of ink ribbon is fed out of the enclosing portion 54 through the outlet 55. The tension lever 60 rotates in the direction of d by the feed-out of the ribbon. Then, the pin 69 is moved into disengagement with the release lever 66. The lock claw allows the ink ribbon to again come into contact with the boss 57, thereby locking it. By repeating the above operations, the ink ribbon is fed out little by little. By feeding out the ribbon in this manner, no excessive tension is applied to the ink ribbon and the ink ribbon 53 is not rubbed by the lock claw 56 and the ribbon is hardly damaged. In addition, the tension lever 60 has the rotational axis 61 and the operational point (roller 63) between which the enclosing unit 54 is arranged, so that the area of the enclosing portion 54 is not reduced.

Figure 1:
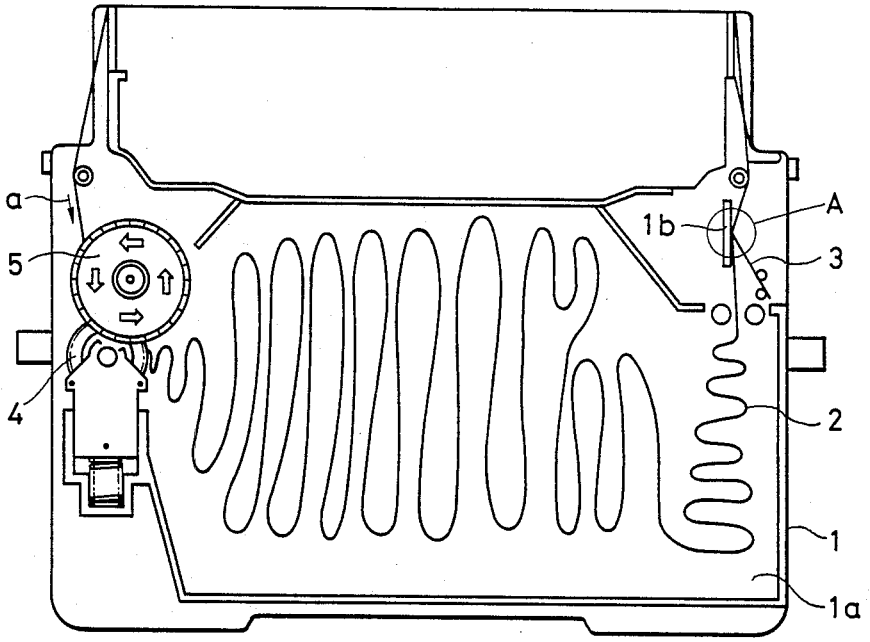
FIG. 1 is an explanatory diagram of a conventional ribbon cassette.
Figure 2:
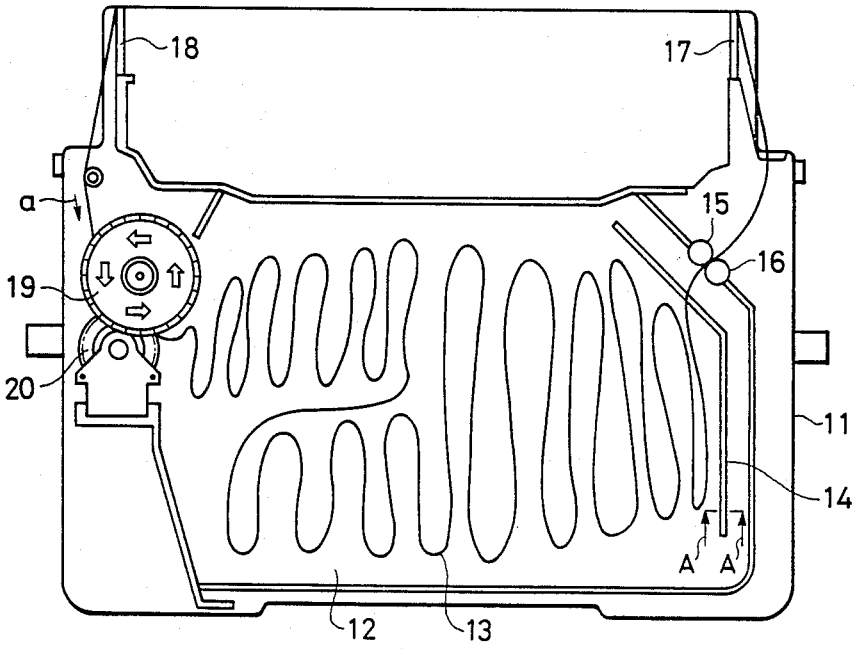
FIG. 2 is an explanatory diagram of a ribbon cassette which is generally used.
Figure 3:
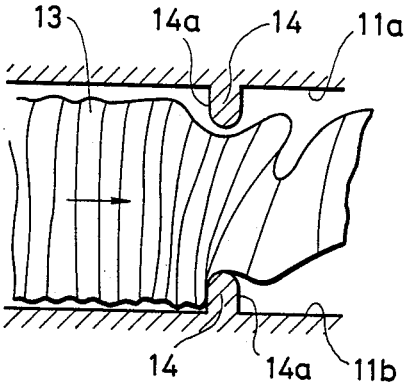
FIG. 3 is a diagram of a conventional example and shows a cross sectional view taken along the line A—A in FIG. 2.
Figure 7:
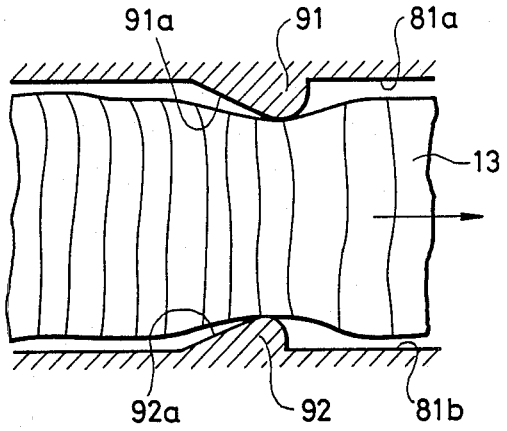
FIG. 7 is an explanatory diagram of the third embodiment of the invention.

FIG. 7 shows the third embodiment of the invention in which the parts and components (not shown) are substantially the same as those shown in FIG. 2. According to this embodiment, ribs 91 and 92 are formed integrally with an upper casing 81*a* and a lower casing 81*b* by the molding process, respectively. The ribs 91 and 92 are formed so as to gently rise and suddenly trail in the direction of thickness of the ribbon from the upstream side to the downstream side with respect to the feeding direction of the ribbon. The ribbon is smoothly fed by oblique surfaces 91*a* and 92*a* of the ribs 91 and 92 in the direction indicated by arrows without being scratched.

Figure 8:
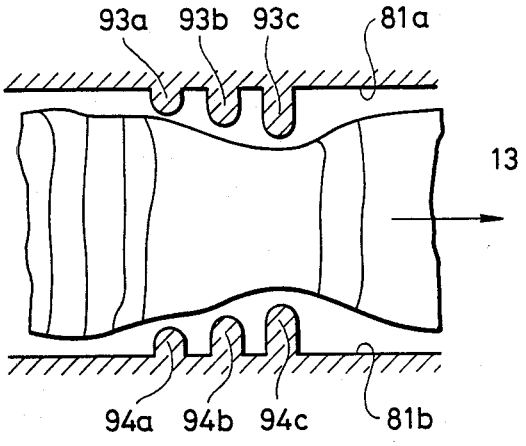
FIG. 8 is an explanatory diagram of the fourth embodiment of the invention.

FIG. 8 shows the fourth embodiment of the invention. A plurality of ribs 93*a*, 93*b*, 93*c*, 94*a*, 94*b* and 94*c* are respectively formed integrally with the upper casing 81*a* and lower casing 81*b*. Each of the ribs 93*a* to 94*c* is the projection having a semicircular tip. These ribs are formed in a manner such that their heights increase little by little from the upstream side to the downstream side, respectively. The lowest ribs 93*a* and 94*a* in the example of FIG. 8 are formed in a manner such that their maximum heights are set to the values so as not to scratch the ribbon in their riser portions.

What is claimed is:

1. An ink ribbon cassette comprising:

an endless type ink ribbon; and a cassette casing for enclosing said ink ribbon, said cassette casing including (a) an enclosing portion for enclosing said ink ribbon in an irregularly piled state, (b) exposing guide means for pulling out the ink ribbon in said enclosing portion and exposing the ink ribbon to the outside and for guiding the exposed ink ribbon so as to be enclosed again into the enclosing portion, (c) take-up means for taking up said ink ribbon, (d) stop means, disposed inside said casing, for pinching said ink ribbon and preventing said ink ribbon from exiting said enclosing portion;

(e) pivotable tension applying means for applying a tension to said ink ribbon, and (f) release means for causing said stop means to release said ink ribbon when said tension applying means pivots into contact with said release means.

2. An ink ribbon cassette according to claim 1, wherein a force which is applied on said ink ribbon by said stop means is larger than a force which is applied on said ink ribbon by said tension applying means.

3. An ink ribbon cassette according to claim 1, wherein said release means causes said stop means to release said ink ribbon after said tension applying means has moved a predetermined distance.

4. An ink ribbon cassette according to claim 1, wherein a portion of said exposing guide means is fixed to a free end of said tension applying means, and wherein said tension applying means is rotatably supported on an inside surfae of said cassette casing.

5. An ink ribbon cassette according to claim 4, wherein a rotational center of said tension applying means is located at a corner of said cassette casing.

* * * * *

UNITED STATES PATENT AND TRADEMARK OFFICE

CERTIFICATE OF CORRECTION

PATENT NO. : 4,828,411

DATED : May 9, 1989

INVENTOR(S) : Oba

It is certified that error appears in the above-identified patent and that said Letters Patent is hereby corrected as shown below:

COLUMN 1

Line 60, change "ink riboon." to --ink ribbon.--.

COLUMN 2

Line 2, change "apparatus" to --apparent--.

Line 12, change "cross sectional" to --cross-sectional--.

Line 36, change "be come" to --be moved--.

COLUMN 3

Line 14, change "be come" to --be moved--.

Line 49, change "frbm" to --from--.

Line 68, change "explaned." to --explained.--.

UNITED STATES PATENT AND TRADEMARK OFFICE

CERTIFICATE OF CORRECTION

PATENT NO. : 4,828,411 Page 2 of 2

DATED : May 9, 1989

INVENTOR(S) : Oba

It is certified that error appears in the above-identified patent and that said Letters Patent is hereby corrected as shown below:

COLUMN 5

Line 3, change "portion;" to --portion,--.

COLUMN 6

Line 9, change "surfae" to --surface--.

Signed and Sealed this

Twenty-seventh Day of March, 1990

*Attest:*

JEFFREY M. SAMUELS

*Attesting Officer*

*Acting Commissioner of Patents and Trademarks*